United States Patent [19]

Sanders

[11] 4,069,688

[45] Jan. 24, 1978

[54] CIRCULAR KNITTING MACHINE DEVICE

[75] Inventor: John Randolph Sanders, Spartanburg, S.C.

[73] Assignee: Milliken, Research Corporation, Spartanburg, S.C.

[21] Appl. No.: 749,389

[22] Filed: Dec. 10, 1976

[51] Int. Cl.[2] ..... D04B 37/02; D04B 15/88

[52] U.S. Cl. ..... 66/1 R; 66/151; 33/172 D

[58] Field of Search ..... 33/169 C, 172 R, 172 D, 33/174 Q; 66/1 R, 151, 149 R

[56] References Cited

U.S. PATENT DOCUMENTS

| | | | |
|---|---|---|---|
| 2,013,563 | 9/1935 | Lawson et al. | 66/149 R X |
| 3,432,932 | 3/1969 | Oellerich | 33/169 C X |
| 3,822,478 | 7/1974 | Aly et al. | 33/172 D |
| 3,985,001 | 10/1976 | Eschenbach | 66/151 X |

*Primary Examiner*—Wm. Carter Reynolds

*Attorney, Agent, or Firm*—Earle R. Marden; H. William Petry

[57] ABSTRACT

A centering and truing device to accurately indicate the position of the baseplate of a large roll take-up mechanism for a circular knitting device. A three-dimensional slider mechanism is suspended from the knitting machine cylinder ledge and the centering member suspended therefrom is adjusted to indicate the position of the knitting machine baseplate.

5 Claims, 6 Drawing Figures

CIRCULAR KNITTING MACHINE DEVICE

It is an object of the invention to provide a centering and truing device which is simple in construction, accurate and can be readily installed and removed with a minimum effort.

Other objects and advantages of the invention will become readily apparent as the specification proceeds to describe the invention, in which.

Figure 1:
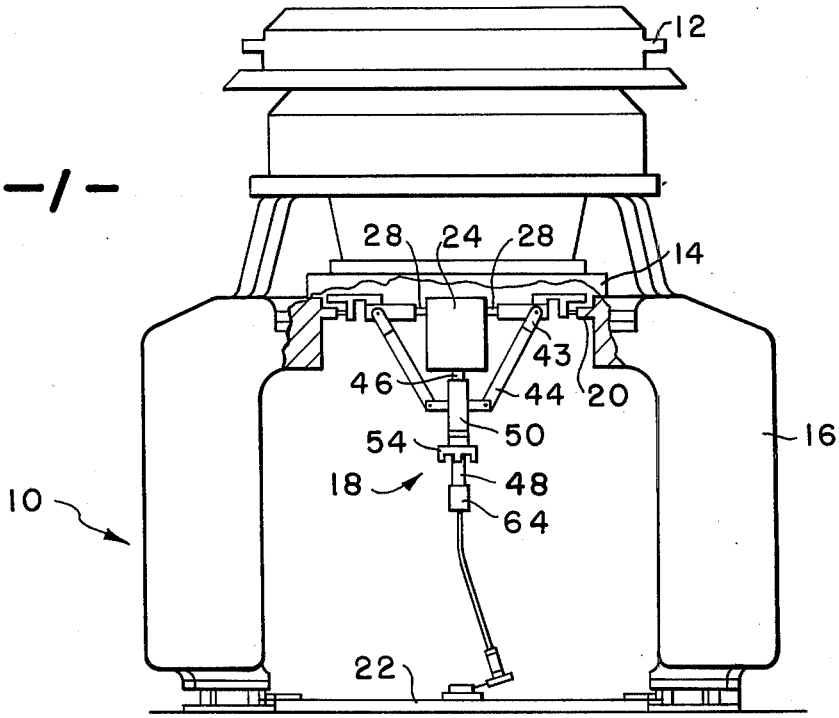
FIG. 1 is a front elevation partially schematic view of a circular knitting machine incorporating the novel centering and truing device.

Looking now to FIG. 1, there is shown a circular knitting machine 10 which is supplied with yarn from an off-side creel (not shown). The machine 10 has conventional components such as yarn guide ring 12 and a rotating needle cylinder 14 all supported on the frame 16. The centering and truing device 18 is located in the cylinder suspended on the cylinder ledge 20 to check the center location of the baseplate or track 22.

As discussed briefly before, the centering and truing device is used to check the center of the baseplate 22 with respect to the centerline of the machine cylinder and the levelness of such plate. The baseplate 22 supports the large roll take-up mechanism shown and disclosed in U.S. Pat. No. 3,985,001.

Figure 2:
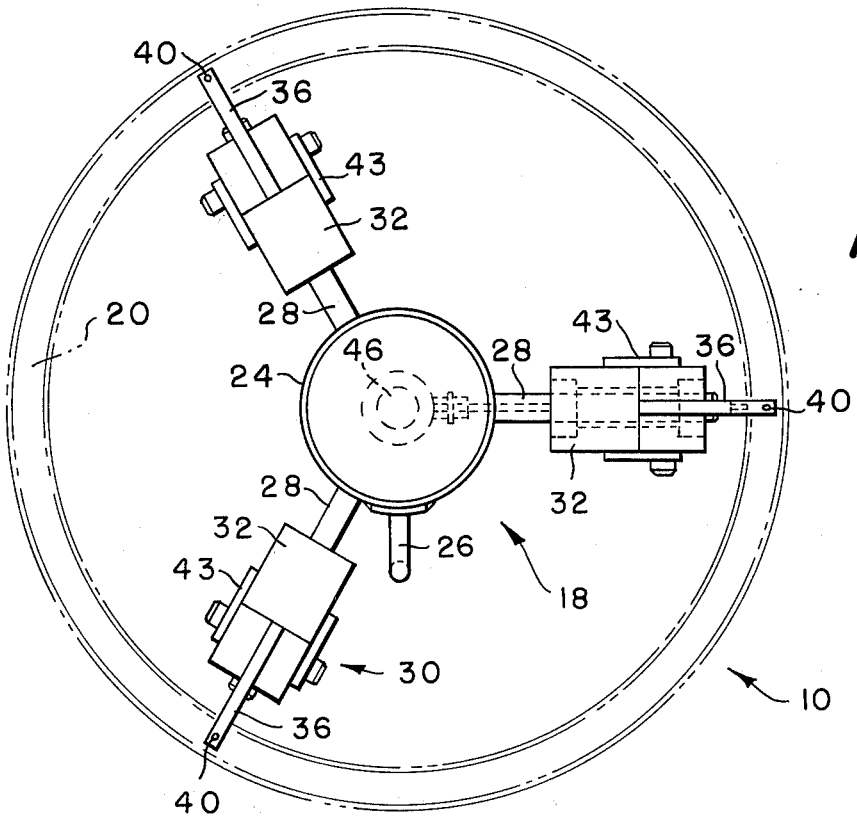
FIG. 2 is a top view of the cylinder ledge showing the centering and truing device in position.
Figure 3:
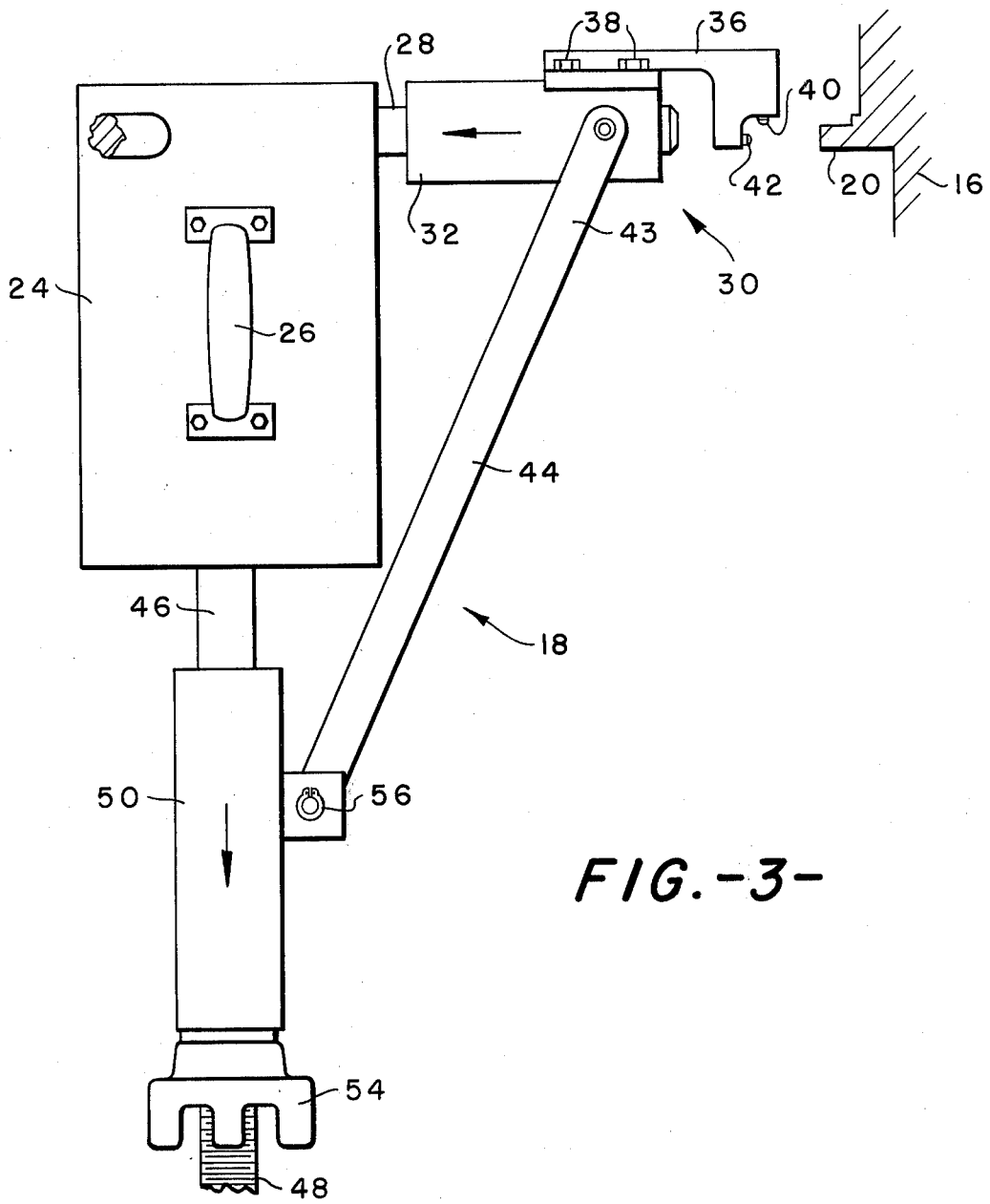
FIG. 3 is a partial elevation of the top portion of the centering and truing device.
Figure 4:
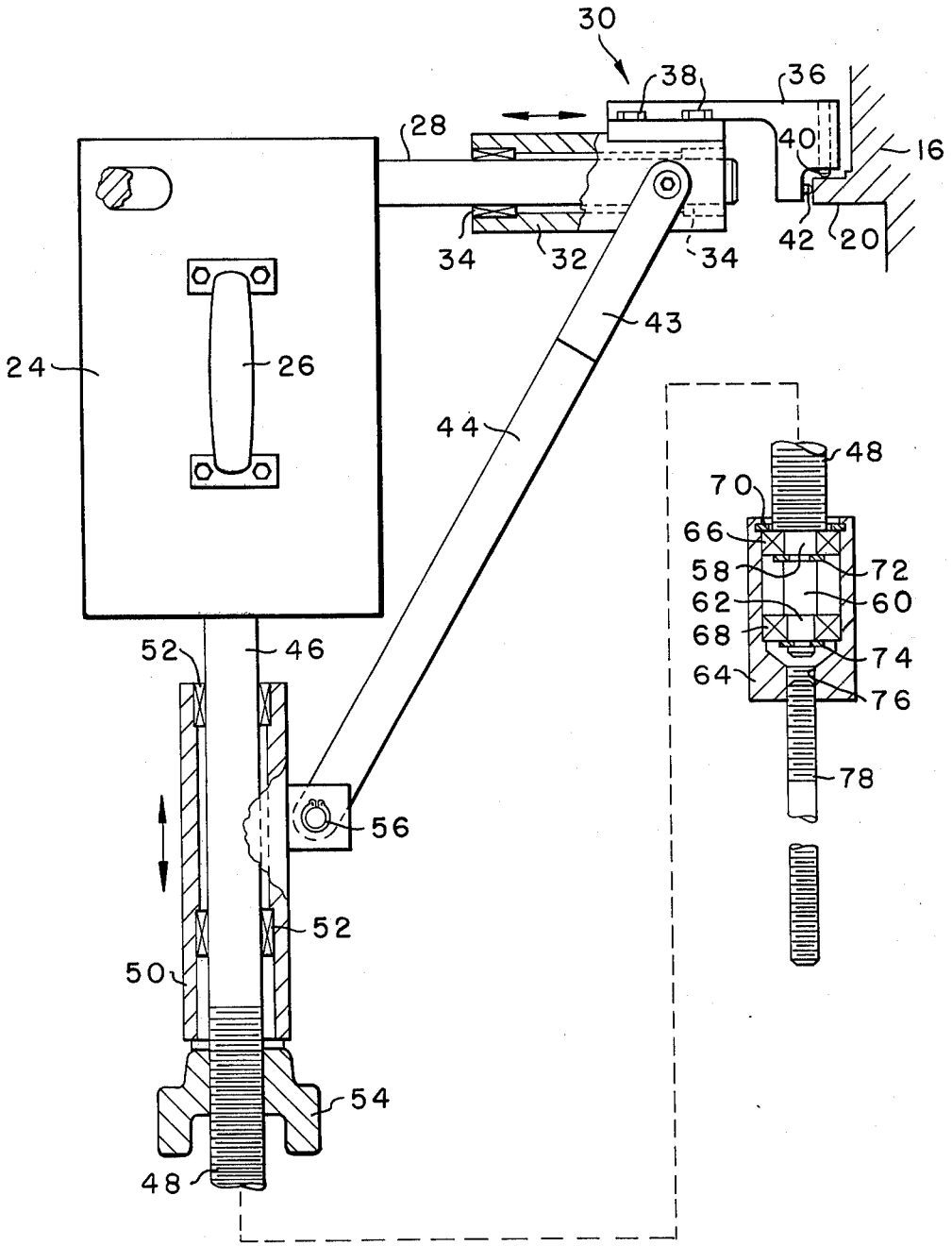
FIG. 4 is a view similar to FIG. 3 showing portions thereof sectioned to more clearly show the details thereof.

Looking now to FIGS 2–4, the centering and truing device 18 is shown in more detail. The device 18 is basically constructed around a hollow cylindrical support member 24 to which is attached a hollow handle 26 for transportation and three rod or shaft members 28 to support the slider members 30. Each of the slider members 30 consists of a slider sleeve 32 slidably mounted on rod 28 by suitable bearings 34 and a L-shaped bracket member 36 mounted to the sleeve 32 by screws 38. Bracket member 36 has an adjustable set screw 40 adapted to contact the top of cylinder ledge 20 and an adjustable set screw 42 to contact the edge of the cylinder edge 20. Pivotally secured to each of the slider sleeves 32 is a U-shaped bracket 43 to which a lever arm 44 is connected by any suitable means, such as by welding.

Projecting upwardly into the cylindrical support member 24 is shaft member 46 which has a threaded bottom portion 48. Telescoped over the shaft 46 is a sleeve member 50 slidably mounted thereon, and substantially perpendicular to slider members 30 by suitable bearings 52, and held in position by nut 54 screwed into the threaded portion 48 of the shaft member 46. The free ends of each of the lever arms 44 is pivotally secured to the outside of the sleeve member 50 to 56. The threaded lower portion 48 of the shaft member 46 has reduced diameter portions 58, 60 and 62 at the end thereof to rotably support a cup member 64 at the end thereof through the bearings 66 and 68 and snap rings 70, 72 and 74.

Figure 5:
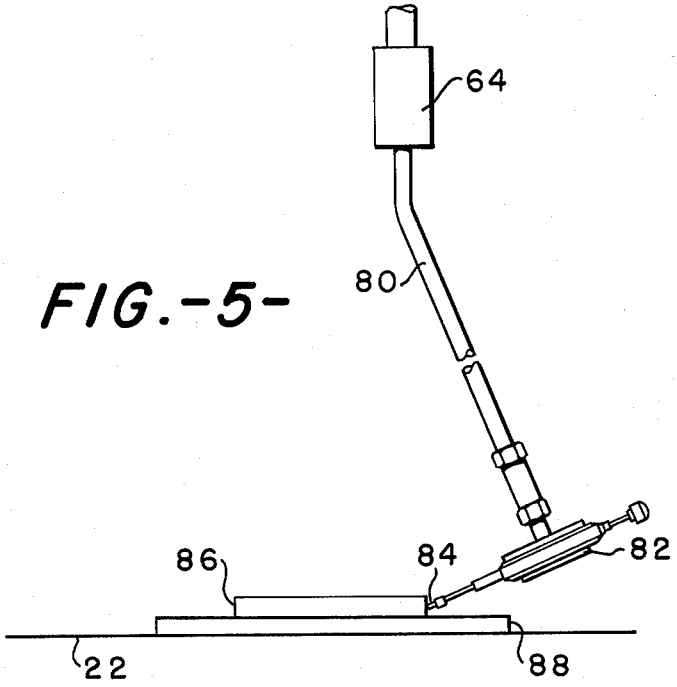
FIG. 5 shows the use of the centering and truing device for center location of the large roll take-up baseplate.
Figure 6:
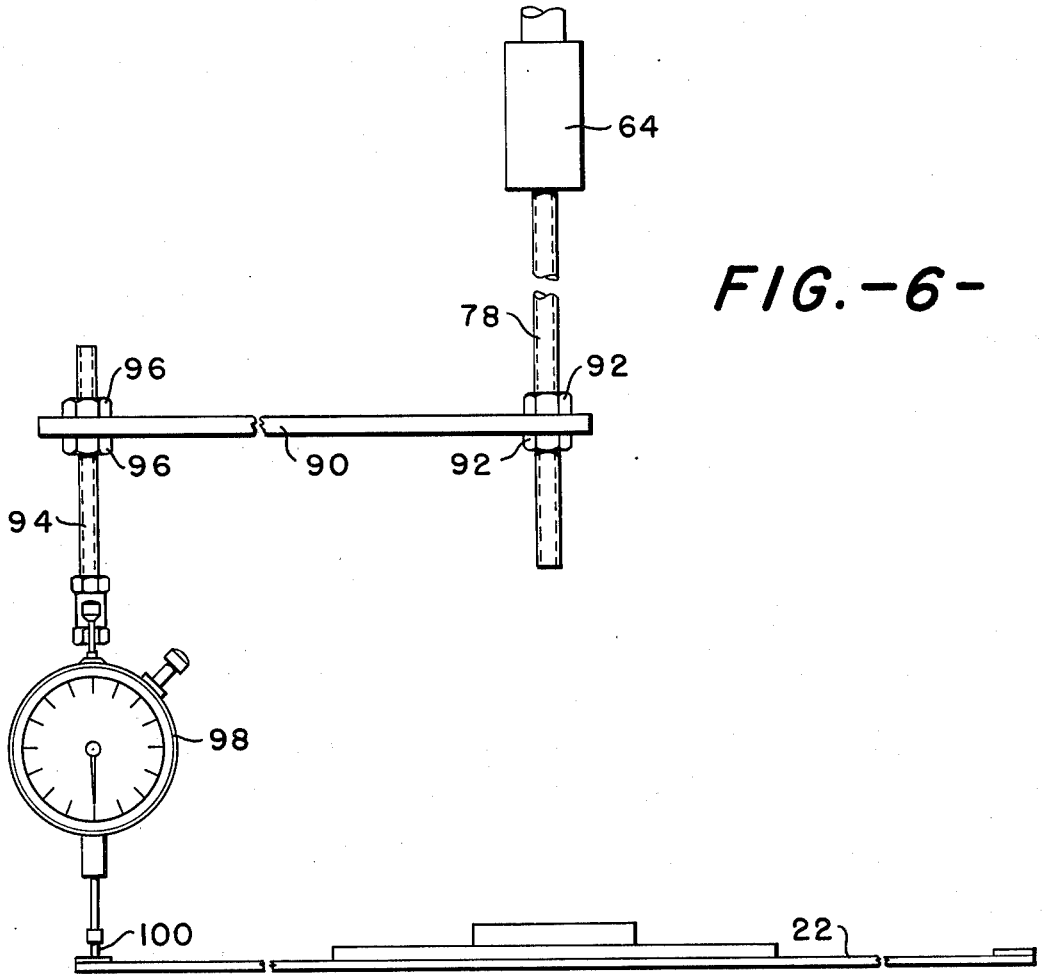
FIG. 6 illustrates the use of the centering and truing device to determine the levelness of the large roll take-up baseplate.

The lower end of the cup member 64 has a tapped opening 76 therein in which is screwed the rod 78 shown in detail in FIG. 6 or the rod 80 shown in detail in FIG. 5. The rod 80 is angled away from the center of the baseplate and has a dial indicator 82 connected at the bottom thereof with its sensing indicator 84 in contact with a centerline plug 86 in the adjustable center pivot housing 88 of the large roll take-up baseplate. In FIG. 6 an arm 90 is secured to the rod 78 by means of cooperating nuts 92. At the other end of the arm 90 is a rod 94 secured to the arm 90 by suitable nut 96. Secured at the bottom end of the rod 94 is an indicator 98 which has its pointer 100 in contact with the periphery of the baseplate 22.

OPERATION

FIGS. 1, 2 and 4–6 show the centering and truing device in operative position in the knitting machine. For the sake of this explanation, it is assumed that the centering and truing device 18 has been calibrated but it should be kept in mind that the device 18 should be calibrated if abused during operation or after about 50 usages or upon the expiration of 1 year.

As pointed out briefly before, it is intended to provide an apparatus to accurately position the large roll take-up baseplate with respect to the knitting machine cylinder. This means that the center of the baseplate 22 must be positioned under the center of the rotation of the knitting machine cylinder and the plane of the baseplate 22 must be parallel to the plane of rotation of the knitting machine cylinder. To accomplish this end, large roll take-up carriage, along with the primary and secondary spreaders with supports therefore, are removed. Then all the dust, dirt, lint, broken needles, etc. is removed from the knitting machine cylinder ledge 20 in preparation for the use of the centering and truing device 18.

In the use of the apparatus 18, the nut 54 is loosened and screwed to allow the sleeve member 50 to be slid downwardly to contract the sliders 32. Then the device is lifted up into the knitting machine and two of the slider sleeves 32 correctly positioned so that the set screws 40 and 42 abut the cylinder ledge 20. Then the nut 54 is tightened until the third slider sleeve 32 is slid horizontally until its set screws are correctly positioned on the cylinder ledge 20. When using the device 18 to check the center location of the baseplate 22, a centerline plug 86 is used in conjunction with the rod 80 shown in FIG. 5. Then the cup 64 is rotated one complete rotation and the readings on the indicator needle of the indicator 82 are noted. These readings will indicate how far or close the center of the baseplate 22 is to the centerline of the device 18 which in turn establishes the baseplate center to the knitting machine center if the device 18 is accurately positioned on the cylinder ledge 20.

If it is desired to determine the levelness of the baseplate 22, which in fact is whether it is parallel to the knitting machine cylinder, the arrangement shown in FIG. 6 is used. As with the arrangement of FIG. 5, the cup 64 is rotated one revolution as the needle readings of the indicator 98 are noted to provide necessary information for adjustment of the baseplate.

As hereinabove described, an apparatus is provided which will allow easy and efficient checking of the relative positions of the baseplate 22 of a large roll take-up device to the cylinder of a circular knitting machine.

Although the preferred embodiment of the invention has been described, it is contemplated that any changes may be made without departing from the scope or spirit of the invention and it is desired that the invention be limited only by the claims.

I claim:

1. Apparatus to measure the centering and levelness of the baseplate of a take-up mechanism for a circular knitting machine comprising: a support member, a first slider member mounted on said support member, at least three slider members located substantially perpendicular to said first slider member, means pivotally securing said first slider member to each of said three slider members, means connected to said support member to adjustably secure said first slider member in position on said support member, a second support member rotably supported on said support member and indicator means connected to said second support member and adapted to contact the baseplate of a take-up mechanism for a circular knitting machine.

2. The apparatus of claim 1 wherein each of said three slider members has a pair of set screws thereon substantially perpendicular to one another.

3. On a circular knitting machine having a rotating needle cylinder and a take-up mechanism baseplate, said needle cylinder having an inwardly directed ledge the improvement being an apparatus to measure the centering and levelness of the baseplate relative to the needle cylinder, the improvement comprising: a first support member, a first slider member mounted on said first support member, at least three slider members located substantially perpendicular to said slider member and in contact with said cylinder ledge, means pivotally connecting said slider member to each of said three slider members, means securing said slider member in position on said first support member, a second support member rotably supported on said first support member and indicator means connected to said second support member and in contact with said baseplate to provide a reading when said second support member is rotated.

4. The improvement of claim 3 wherein each of said three slider members has a first set screw in contact with said cylinder ledge.

5. The improvement of claim 4 wherein each of said three slider members has a second set screw in contact with said cylinder ledge and substantially perpendicular to said first set screw.

* * * * *

UNITED STATES PATENT OFFICE

CERTIFICATE OF CORRECTION

Patent No. 4,069,688 Dated January 24, 1978

Inventor(s) John R. Sanders

It is certified that error appears in the above-identified patent and that said Letters Patent are hereby corrected as shown below:

Column 1, line 65, delete the word "to", second occurrence, and substitute therefor --at--.

Signed and Sealed this

Sixth Day of June 1978

[SEAL]

*Attest:*

RUTH C. MASON
*Attesting Officer*

DONALD W. BANNER
*Commissioner of Patents and Trademarks*